United States Patent [19]

Datlow

[11] 3,970,578

[45] July 20, 1976

[54] ADDITIVE COMPOSITION FOR TEXTILE BLEACHING BATHS

[75] Inventor: Bernard J. Datlow, Elizabeth, N.J.

[73] Assignee: Bernard J. Datlow, Elizabeth, N.J.

[22] Filed: Apr. 15, 1974

[21] Appl. No.: 460,777

[52] U.S. Cl. ..... 252/186; 8/101; 8/111; 252/8.6; 252/99; 252/389 A

[51] Int. Cl.[2] ..... D06L 3/12; D06L 3/08; D06L 3/02

[58] Field of Search ..... 252/186, 99, 8.6, 75, 252/389 A, 387; 8/111, 108, 101, DIG.14

[56] References Cited

UNITED STATES PATENTS

| | | | |
|---|---|---|---|
| 3,350,161 | 10/1967 | Papini | 8/111 |
| 3,746,646 | 7/1973 | Boixader | 8/111 |
| 3,756,774 | 9/1973 | Kirner | 8/111 |

*Primary Examiner*—Benjamin R. Padgett
*Assistant Examiner*—Irwin Gluck

[57] ABSTRACT

An additive composition in an aqueous vehicle for use in textile bleaching baths wherein textiles passed through bleaching baths modified by the addition thereto of the additive composition show improved characteristics including (1) perceptible increase in whiteness, and (2) more uniform distribution of dyes applied to the bleached textile and a greater intensity of the colorant in the fabric. The additive composition in aqueous form, comprises essentially, sodium zinc hexametaphosphate, zinc borate, and urea.

4 Claims, No Drawings

ADDITIVE COMPOSITION FOR TEXTILE BLEACHING BATHS

BACKGROUND OF THE INVENTION

In order to secure a desired degree of whiteness in textile fabrics subject to conventional bleaching procedures, it is known in the art to use optical brighteners as modifiers for the bleaching baths. However, the use of such optical brighteners, in many cases has an adverse effect when the bleached fabric is dyed. Thus, in such cases, the dye may be deposited non-uniformly and may not have the desired degree of true intensity of the colorant. Further, the colorant may have an undesired hue.

Accordingly, an object of this invention is to provide an additive composition in aqueous form, which is incorporated in conventional baths for bleaching textiles, wherein the whiteness of the bleached fabric is perceptibly enhanced without the need for optical brighteners.

Another object of this invention is to provide an additive composition of the character described, which when incorporated in textile bleaching baths, has the property of not only improving the whiteness characteristic of the bleached fabric, but further, improves the dyeing properties of the bleached fabric, including greater uniformity in the receptivity of the applied dye and an increase in intensity of the color of the applied dye.

Yet another object of this invention is to provide an additive composition of the character described for incorporation in textile bleaching baths, which eliminates the need for optical brighteners, and by omitting such optical brighteners, avoids undesired hues of the colorant applied in the dyeing of the bleached fabric.

Still another object of this invention is to provide an additive for textile bleaching baths of the character described whereby textile fabrics derived from cotton, cotton-nylon blends and other natural or synthetic fibers and mixtures thereof bleached in such modified baths show perceptibly increased whiteness and when dyed show greater uniformity of distribution of the colorant in the fabric and improved receptivity of the colorant.

Yet another object of this invention is to provide an additive composition for use in textile bleaching baths, which is in aqueous form and comprises as essential constituents, sodium zinc hexametaphosphate, zinc borate and urea.

Other objects of this invention will in part be obvious and in part hereinafter pointed out.

DESCRIPTION OF THE PREFERRED EMBODIMENTS

In accordance with the instant invention, conventional bleaching and after bleaching baths, such as the dilute hypochlorite and dilute peracetic baths are modified by adding to such baths an aqueous composition having as active ingredients sodium zinc hexametaphosphate, zinc borate and urea.

The additive composition may be prepared by adding 792 grams of Calgon TG-10, otherwise known as sodium zinc hexametaphosphate to 9 gallons of distilled water at about 170° F, with stirring until dissolved. Nine grams of zinc borate and 120 grams of urea are successively added to the phosphate solution with stirring; followed by slow cooling to room temperature.

The thus prepared aqueous additive composition was used in a conventional textile bleaching bath, wherein dilute peracetic acid is the active bleaching agent. Thus, 150 cc. of the additive composition was added to 35 gallons of the dilute peracetic acid held in a bleaching tank at a temperature of from 160° F to 180° F. Cotton fabric was processed through the successive steps of a conventional bleaching operation except that the aforesaid additive composition was added to the dilute peracetic acid bath as indicated above.

Upon comparing the bleached fabric processed with the additive composition of the instant invention, with bleached fabric processed with the same bleaching agent but without the additive composition; it was apparent that the whiteness of the former processed fabric perceptibly exceeded the whiteness of the latter processed fabric.

Further, the bleached fabric which was processed with the additive of the instant invention, showed improved receptivity for dyes which were uniformly distributed and had increased intensity. The ommission of optical brighteners avoided any variation in hue of the applied colorant.

The additive of the instant invention was also used in dilute (0.5%) hypochlorite bleaching baths, with 2,000 cc. of the additive composition being admixed with 2200 gallons of the dilute hypochlorite solution. Fabrics processed in such modified bleaching baths resulted in perceptibly noticed increase in whiteness and improved dyeing characteristics including greater uniformity of distribution of colorant and increased color intensity.

In addition to cotton fabrics, fabrics made of cotton-nylon blends, as well as other natural and synthetic fibers and mixtures thereof, bleached with the modified baths as set forth above, showed improved whiteness and dyeing characteristics in the absence of optical brighteners.

The proportions of the several ingredients in the additive composition of the instant invention, may be varied as indicated below:

| | Sodium Zinc hexametaphosphate | Zinc Borate | Urea |
|---|---|---|---|
| (1) | 700 grams | 7.5 grams | 95 grams |
| (2) | 650 grams | 6.7 grams | 60 grams |
| (3) | 600 grams | 5.0 grams | 70 grams |

Thus, the additive composition may be made up of from about 85% to 90% sodium zinc hexametaphosphate; 1.0% to 1.4% zinc borate; and 8.3% to 14.0% urea, all by weight. Such ingredients are made up with suitable amounts of distilled water, as set forth above.

It is understood that the additive of the instant invention may be used in textile bleaching baths which include optical brighteners where it is not intended to dye the bleached fabric. In such case, bleached fabric processed with both additive and optical brighteners will have a whiteness oerceptibly greater then the whiteness of a fabric processed in bleaching baths including optical brighteners but without the additive of the instant invention.

It is further understood that the proportion of the solid ingredients of the addtive to the water carrier thereof, may be varied to suit particular bleaching operations. Also, the proportion of the aqueous additive composition to a given bleaching bath containing the active bleaching agent, may be adjusted to suit the specific bleaching agent and the nature of the fabric being bleached.

I claim:

1. An aqueous additive composition for textile bleaching baths wherein the relative amounts of ingredients of said additive constituent comprises from 85.0% to 90.0% sodium zinc hexametaphosphate, 1.0% to 1.4% zinc borate and 8.3% to 14.0% urea, all by weight.

2. An additive as in claim 1 wherein said sodium zinc hexametaphosphate comprises about 86.0%; said zinc borate comprises about 1.0%; and said urea comprises about 13.0%, all by weight.

3. An aqueous additive composition as in claim 1 wherein the ingredients are in a relative relationship whereby said aqueous portion amounts to about 34 liters, and wherein in said additive said zinc hexametaphosphate amounts to from 600 to 792 grams, said zinc borate amounts to from 5.0 to 9.0 grams and said urea amounts to from 60 to 120 grams.

4. An additive as in claim 3, wherein said sodium zinc hexametaphosphate amounts to 792 grams, said zinc borate amounts to 9.0 grams, and said urea amounts to 120 grams.

* * * * *